US006791539B2

(12) United States Patent
Nakajima et al.

(10) Patent No.: US 6,791,539 B2
(45) Date of Patent: Sep. 14, 2004

(54) DISPLAY, METHOD FOR DRIVING THE SAME, AND PORTABLE TERMINAL

(75) Inventors: Yoshiharu Nakajima, Kanagawa (JP); Toshikazu Maekawa, Kanagawa (JP)

(73) Assignee: Sony Corporation (JP)

( * ) Notice: Subject to any disclaimer, the term of this patent is extended or adjusted under 35 U.S.C. 154(b) by 251 days.

(21) Appl. No.: 09/980,251

(22) PCT Filed: Mar. 27, 2001

(86) PCT No.: PCT/JP01/02475

§ 371 (c)(1),
(2), (4) Date: Apr. 17, 2002

(87) PCT Pub. No.: WO01/78051

PCT Pub. Date: Oct. 18, 2001

(65) Prior Publication Data

US 2002/0135556 A1 Sep. 26, 2002

(30) Foreign Application Priority Data

Apr. 5, 2000 (JP) ..... 2000-102997

(51) Int. Cl.[7] ..... G09G 3/36

(52) U.S. Cl. ..... 345/204; 345/98; 345/100; 345/204

(58) Field of Search ..... 345/87, 98, 99, 345/100, 204

(56) References Cited

U.S. PATENT DOCUMENTS 5,394,166 A 2/1995 Shimada ..... 345/98
5,726,676 A 3/1998 Callahan, Jr. et al.
5,867,140 A 2/1999 Rader ..... 345/98
2002/0126107 A1 * 9/2002 Inoue et al. ..... 345/204
2002/0175887 A1 * 11/2002 Yamazaki ..... 345/87

FOREIGN PATENT DOCUMENTS

EP 974 952 1/2000
JP 10-96958 4/1998
JP 11-184434 7/1999

OTHER PUBLICATIONS

European Search Report Dec. 13, 2002.

European Search Report Aug. 23, 2002.

* cited by examiner

*Primary Examiner*—Regina Liang
(74) *Attorney, Agent, or Firm*—Rader, Fishman & Grauer PLLC; Ronald P. Kananen

(57) ABSTRACT

This invention provides a liquid crystal display device having a partial screen display mode, in which a latch control circuit (17) first stores white data or black data as color data of one line to latch circuits (121), (131) at the beginning of an image non-display period and then repeatedly reads out and outputs the color data to respective column lines in a display area (11) until the display period ends, thereby stopping the operation to write data to the latch circuits (121), (131) substantially during the entire image non-display period.

20 Claims, 11 Drawing Sheets

DISPLAY, METHOD FOR DRIVING THE SAME, AND PORTABLE TERMINAL

TECHNICAL FIELD

This invention relates to a display device, a driving method therefor, and a portable terminal equipment. Particularly, it relates to a display device which uses a liquid crystal cell or an EL (electroluminescence) element as a pixel display element, a driving method therefor, and a portable terminal equipment such as a portable telephone having such a display device mounted thereon.

BACKGROUND ART

As a display device for a portable terminal equipment represented by a portable telephone, a liquid crystal display device or an EL display device has been broadly used. In principle, the liquid crystal display device and the EL display device are display devices of low power consumption which do not need large power for driving. Therefore, these display devices are advantageously used in portable terminal equipments.

For example, a liquid display device mounted on a portable telephone may make display in a part of its screen, as a display function of standby mode or the like. Hereinafter, this display mode is referred to as a partial screen display mode. In order to realize such a partial screen display mode for making display in a part of the screen in the standby mode or the like, the liquid crystal display device or the EL display device must carry out a refresh operation using a certain image signal such as a white signal or a black signal, not only in an area for display a target image on the screen but also in a non-display area.

Since the liquid crystal display device or the EL display device must carry out the refresh operation also in the non-display area when realizing the partial screen display mode as described above, a driver circuit for driving pixels must be constantly fully operated even in the standby mode or the like. Therefore, power for this driving is required and reduction in power consumption is made difficult.

In a liquid crystal display device of normally-white display, if black display is made in a non-display area in the partial screen display mode, the charge and discharge current with respect to the device capacitance increases, preventing reduction in power consumption. The same is true of white display made in a non-display area in a liquid crystal display device of normally-black display. Moreover, in the EL display device, if white display is made in a non-display area, a light-emitting current must constantly flow and this also prevents reduction in power consumption.

DISCLOSURE OF THE INVENTION

In view of the foregoing status of the art, it is an object of the present invention to provide a display device which enables realization of a partial display mode with a simple structure and reduction in power consumption, a driving method therefor, and a portable terminal equipment having this display device mounted thereon.

According to the present invention, there is provided a display device which has storage means for storing data of one line and is adapted for making regular image display in a partial area in the direction of row, in a display area having pixels arranged in the form of a matrix, on the basis of the data of one line stored in the storage means and for making specified color display in the remaining area. In the display device, the operation to write data of one line to the storage means is repeatedly carried out for every line during the display period for making regular image display, whereas data of one line is written to the storage means at the beginning of the display period for making specified color display and the data written to the storage means is repeatedly read out during the display period.

With such a structure according to the present invention, during the display period for making regular image display, inputted image data is sequentially stored into the storage means by one line each, and the stored data of one line is sequentially read out from the storage means and supplied as display data of each pixel to the display area. On the other hand, during the display period for making specified color display, color data of one line (for example, white data or black data) is first written to the storage means at the beginning of the display period and then the stored data is held until the display period ends. During this display period, the stored data in the storage means is repeatedly read out and supplied as display data of each pixel to the display area.

The other objects and specific advantages of the present invention will be further clarified from the following description of embodiments.

BEST MODE FOR CARRYING OUT THE INVENTION

The display device and the driving method therefor according to the present invention will now be described in detail with reference to the drawings. In the following description, the present invention is applied to a liquid crystal display (LCD) device using a liquid crystal cell as a pixel display element. However, the present invention can also be applied to an EL display device using an EL element.

Figure 1:
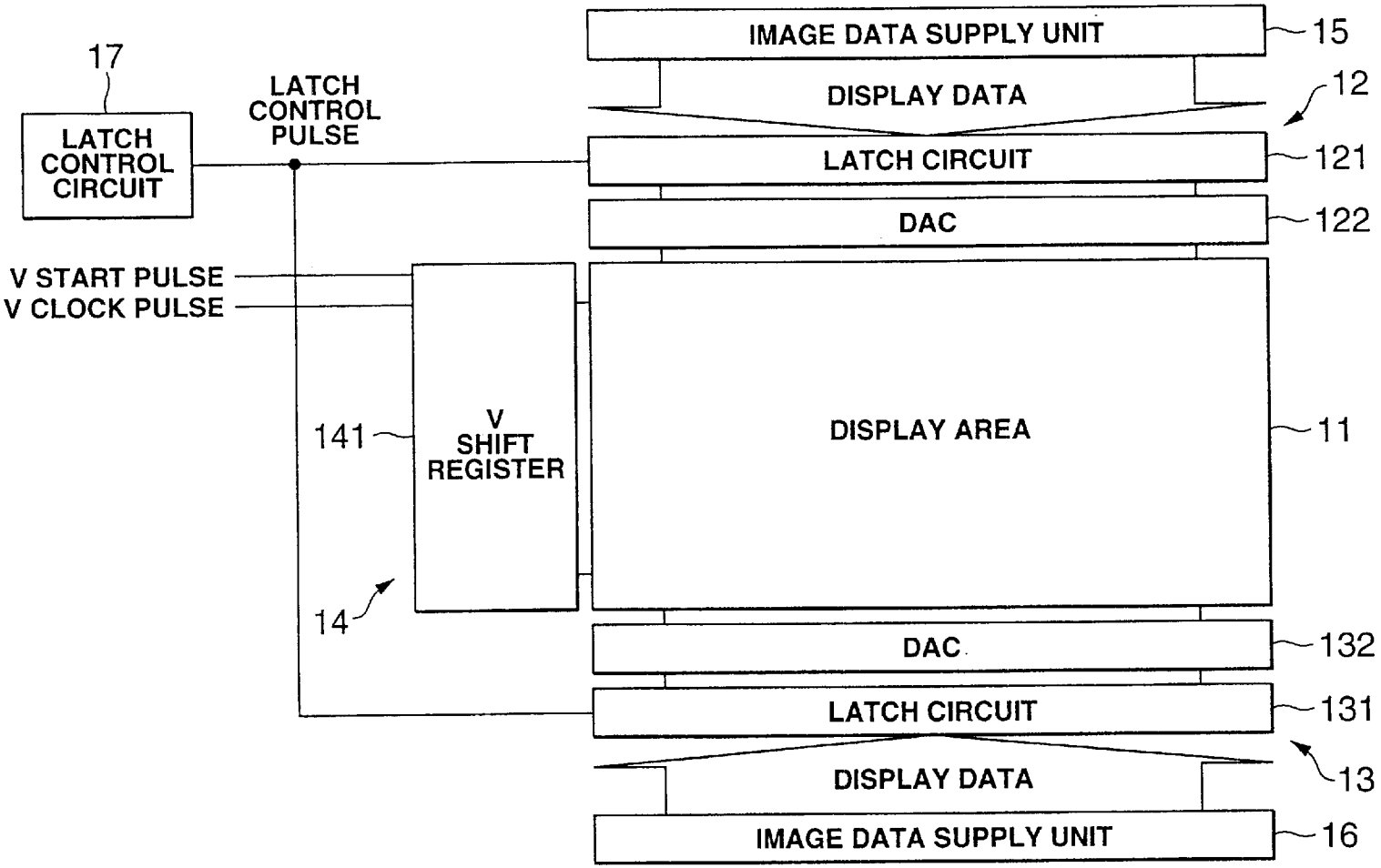
FIG. 1 is a block diagram showing an exemplary structure of a liquid crystal display device according to the first embodiment of the present invention.

FIG. 1 is a block diagram showing an exemplary structure of a liquid crystal display device as the first embodiment of the present invention.

In FIG. 1, for example, first and second horizontal driving systems 12, 13 are arranged above and below a display area 11 of an active matrix in which pixels are arranged in the form of a matrix, and a vertical driving system 14 is arranged on the left side in FIG. 1. The horizontal driving system need not necessarily be arranged above and below the display area 11, and may also be arranged only above or below the display area 11. The vertical driving system may also be arranged on the right side in FIG. 1 or may be arranged on both the left and right sides.

At least a part of the circuit of the first and second horizontal driving systems 12, 13 and the vertical driving system 14 is integrally formed on a first substrate which is the same substrate as that of the display area 11, for example, a glass substrate, by using a TFT (thin film transistor). A second substrate as a counter-substrate of the first substrate is arranged to face the first substrate at a predetermined spacing. A liquid crystal layer is held between the two substrates. In this manner, an LCD panel is constructed.

The first horizontal driving system 12 has a latch circuit 121, which is storage means for storing image data supplied as parallel data from an image data supply unit 15, by one horizontal line each (hereinafter simply referred to as one line), and a DA (digital-analog) converter (DAC) 122 for converting the display data of one line to an analog signal and supplying the analog signal to the display area 11 by each column.

Similarly to the first horizontal driving system 12, the second horizontal driving system 13 has a latch circuit 131 for latching image data supplied from an image data supply unit 16, by one line each, and a DA converter (DAC) 132 for converting the display data of one line latched by the latch circuit 131 to an analog signal and supplying the analog signal to the display area 11 by each column.

For the first and second horizontal driving systems 12, 13, a common latch control circuit 17 as control means for controlling writing and reading of data to and from the latch circuits 121, 131 is provided. The latch control circuit 17, too, is integrally formed on the same substrate as that of the display area 11 by using a TFT. The specific operation of the latch control circuit 17 will be described in detail later.

The vertical driving system 14 is constituted by a vertical shift register 14. The vertical shift register 141 is supplied with a vertical (V) start pulse and a vertical block pulse. Thus, the vertical shift register 141 carries out vertical scanning in the cycle of the V clock pulse in response to the V start pulse, thereby sequentially providing a row selecting pulse to the display area 11 by each row.

Figure 2:
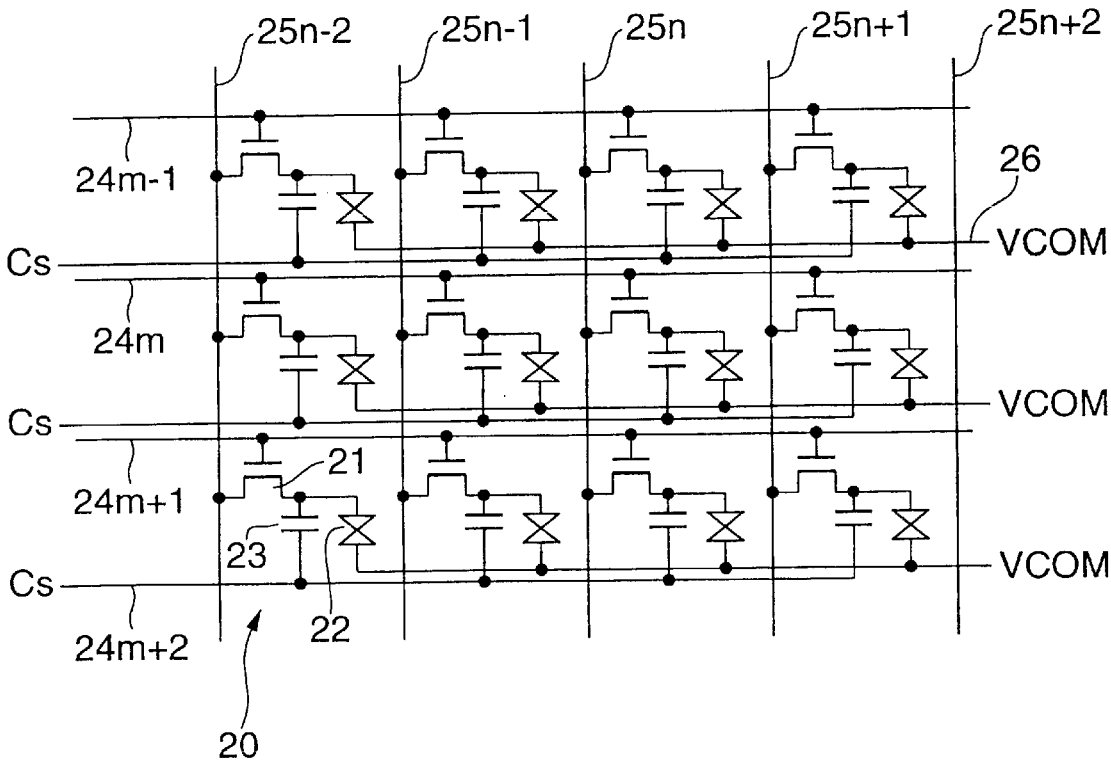
FIG. 2 is an equivalent circuit diagram showing an exemplary structure of each pixel in a display area.

FIG. 2 shows an exemplary structure of each pixel 20 in the display area 11. The pixel 20 is constituted by a TFT 21 as a switching element, a liquid crystal cell 22 with its pixel electrode connected with the drain electrode of the TFT 21, and an auxiliary capacitance 23 with its one electrode connected with the drain electrode of the TFT 21. In this pixel structure, the TFTs 21 of the individual pixels 20 have their respective gate electrodes connected with row lines as vertical selection lines 24m−1, 24m, 24m+1, . . . , and have their respective source electrodes connected with column lines as signal lines 25n−1, 25n, 25n+1, . . .

The counter-electrode of the liquid crystal cell 22 is connected with a common line 26 supplied with a common voltage VCOM. As a method for driving the liquid crystal cell 22, a so-called common inversion driving method is employed such that the common voltage VCOM is inverted every 1H (one horizontal interval). By using this common inversion driving method, the polarity of the common voltage VCOM is inverted every 1H. Therefore, reduction in voltage is realized in the first and second horizontal driving systems 12, 13 and the power consumption of the whole device can be reduced.

The operation of the liquid crystal display device according to the present invention having the above-described structure will now be described. It is assumed that this liquid crystal display device has two display modes, that is, a full-screen display mode for making regular image display on the full screen and a partial screen display mode for making regular image display in a part of the screen.

These two display modes are realized by the control of writing/reading of data to/from the latch circuits 121, 131 by latch control circuit 17. In this embodiment, the latch circuits 121, 131 are controlled by the single latch control circuit 17. However, it is also possible to provide separate latch control circuits 17 for the latch circuits 121, 131, respectively.

First, in the full-screen display mode, the latch control circuit 17 controls the latch circuits 121, 131 to sequentially repeat, by each line, the operation to store image data supplied from the image data supply unit 15, 16 to the latch circuits 121, 131 by one line each and to read out the stored data of one line from the latch circuits 121, 131.

The image data of one line read out from the latch circuits 121, 131 is converted to an analog signal by the DA converters 122, 132 and is outputted as display data to the respective column lines of the display area 11. Then, a row is selected in accordance with a row selecting pulse from the vertical shift register 141 and the display data is sequentially written to pixel electrodes by each row. Thus, full-screen display corresponding to the image data supplied from the image data supply units 15, 16 is made.

On the other hand, in the partial screen display mode, the screen is divided into an image display area for making prescribed image display and an image non-display area for making specified color display (in this embodiment, white or black display). In this embodiment, prescribed image display is made in an image display area made Up of a plurality of lines (rows) from the top of the screen and white display is made in an image non-display area.

First, in the image display area, the operation similar to that of the full-screen display mode is carried out. Specifically, the latch control circuit 17 controls the latch circuits 121, 131 to sequentially repeat, by each line, the operation to write and read out image data supplied from the image data supply units 15, 16 by one line each. Thus, in the image display area, normal image display corresponding to the image data supplied from the image data supply units 15, 16 is made.

As for the image non-display area, that is, the white display area, the latch control circuit 17 first stores white data of one line supplied from the image data supply units 15, 16 into the latch circuits 121, 131 at the beginning of the display period, then passes the white data through the DA converters 122, 132, and outputs the white data to the respective column lines of the display area 11. In this case, the next row (first row in the image non-display area) is selected in accordance with a row selecting pulse from the vertical shift register 141 and the data is sequentially written to pixel electrodes by each row. Thus, white display is made in the first row in the image non-display area.

The white data of one line stored in the latch circuits 121, 131 is held in the latch circuits 121, 131 until the image non-display period ends. With respect to the second and subsequent rows in the image non-display area, the latch control circuit 17 repeatedly reads out the white data of one line held in the latch circuits 121, 131 in the cycle of one line, until the image non-display period ends.

The white data of one line thus read out is passed through the DA converters 122, 132 and is sequentially outputted to the respective column lines of the display area 11. By repeating this operation, white display is made in all the rows in the image non-display area. Ultimately, in the display area 11, normal image display is made only in a partial area and white display is made in the whole remaining area, irrespective of the inputted data.

As described above, in the liquid crystal display device having the partial screen display mode, color data of one line is first stored in the latch circuits 121, 131 at the beginning of the image non-display period, and then the color data is repeatedly read out in the cycle of one line and outputted to the respective column lines of the display area 11 until this display period ends. Thus, since the operation to write data to the latch circuit 121, 131 is not carried out at all substantially during the entire image non-display period, reduction in power consumption is realized by the amount of power necessary for the write operation.

In the above-described embodiment, white display is made in the image non-display area. It is effective also in the case of a liquid crystal display device of normally-white display. This is because continuation of white display in the liquid crystal display device of normally-white display requires less charge and discharge currents with respect to the device capacitance than continuation of black display and is therefore advantageous to reduction in power consumption. On the contrary, in a liquid crystal display device of normally-black display, continuation of black display requires less charge and discharge currents with respect to the device capacitance and is therefore advantageous to reduction in power consumption.

The present invention can be applied not only to a liquid crystal display device but also to an EL display device. In the case of the EL display device, since a light-emitting current is kept flowing for making white display, black display in the image non-display area instead of white display is more advantageous to reduction in power consumption.

Figure 3:
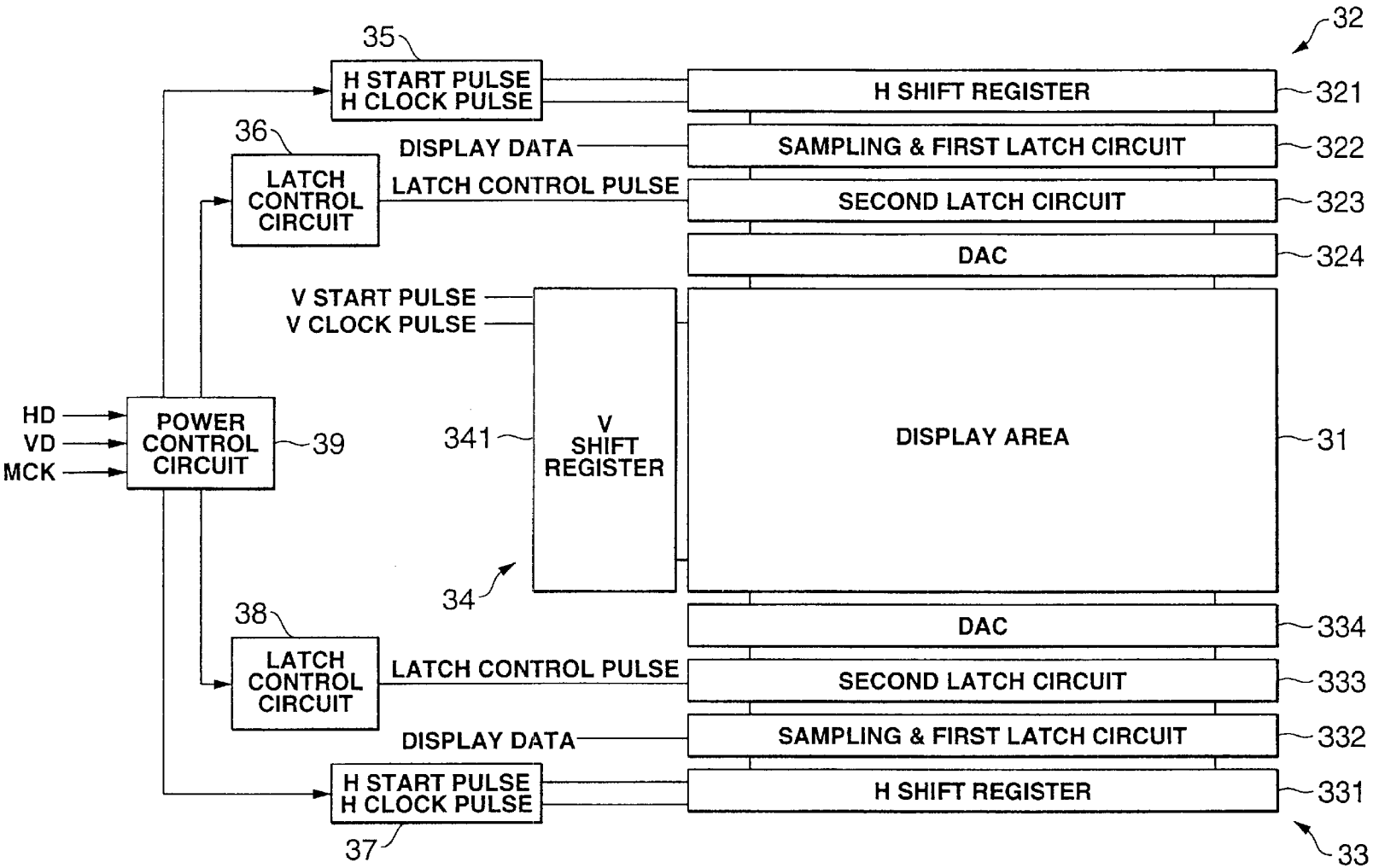
FIG. 3 is a block diagram showing an exemplary structure of a liquid crystal display device according to the second embodiment of the present invention.

FIG. 3 is a block diagram showing an exemplary structure of a liquid crystal display device according to the second embodiment of the present invention.

In FIG. 3, for example, first and second horizontal driving systems 32, 33 are arranged above and below a display area 31 of an active matrix in which pixels are arranged in the form of a matrix, and a vertical driving system 34 is arranged on the left side in FIG. 3. The horizontal driving system need not necessarily be arranged above and below the display area 31, and may also be arranged only above or below the display area 31. The vertical driving system may also be arranged on the right side in FIG. 3 or may be arranged on both the left and right sides.

At least a part of the circuit of the first and second horizontal driving systems 32, 33 and the vertical driving system 34 is integrally formed on a first substrate which is the same substrate as that of the display area 31, for example, a glass substrate, by using a TFT. A second substrate (counter-substrate) is arranged to face the glass substrate at a predetermined spacing. A liquid crystal layer is held between the two substrates. In this manner, an LCD panel is constructed.

The first horizontal driving system 32 has a horizontal shift register 321, a sampling and first latch circuit 322, a second latch circuit 323 and a DA converter 324. Similarly to the first horizontal driving system 32, the second horizontal driving system 33 has a horizontal shift register 331, a sampling and first latch circuit 332, a second latch circuit 333 and a DA converter 334.

The operation of the respective circuits of the first and second horizontal driving systems 32, 33 will now be described. Although the first horizontal driving system 32 is used as an example in the following description, the same description applies to the second horizontal driving system 33.

In the first horizontal driving system 32, the horizontal shift register 321 is supplied with a horizontal (H) start pulse and a horizontal clock pulse from a clock generating circuit 35. Thus, the horizontal shift register 321 carries out horizontal scanning by sequentially generating a sampling pulse in the cycle of the H clock pulse in response to the H start pulse.

The sampling and first latch circuit 322 is supplied with image data (display data) as serial data from an external image data supply source (not shown). The sampling and first latch circuit 322 sequentially samples the display data synchronously with the sampling pulse outputted from the horizontal shift register 321, and latches the sampled data of one line (1H) corresponding to each column line of the display area 31.

The second latch circuit 323 re-latches the data of 1H corresponding to each column line of the display area 31, latched by the sampling and first latch circuit 322, by every 1H in response to a latch control pulse provided in the cycle of 1H from a latch control circuit 36 in the case of the full-screen display mode. The operation at the second latch circuit 323 in the partial screen display mode will be described in detail later. The DA converter 324 converts the display data of one line latched by the second latch circuit 323 to an analog signal and outputs the analog signal to each column line of the display area 31.

In the second horizontal driving system 33, too, the horizontal shift register 331 is supplied with an H start pulse and an H block pulse from a pulse generating circuit 37. The sampling and first latch circuit 332 is supplied with image data (display data) as serial data from an external image data supply source. The second latch circuit 333 is supplied with a latch control pulse from a latch control circuit 38.

For the pulse generating circuits 35, 37 and the latch control circuits 36, 38, a power control circuit 39 for controlling the operating states of these circuits is provided. The power control circuit 39 controls the operating states of the pulse generating circuits 35, 37 and the latch control circuits 36, 38 in accordance with the display mode of the display area 31. The specific structure of the power control circuit 39 will be described later.

At least a part of the circuit of the pulse generating circuits 35, 37, the latch control circuits 36, 38 and the power control circuit 39 is integrally formed on the same substrate as that of the display area 31 by using a TFT.

The vertical driving system 34 is constituted by a vertical shift register 341. The vertical shift register 341 is supplied with a vertical (V) start pulse and a vertical clock pulse. Thus, the vertical shift register 341 carries out vertical scanning in the cycle of the V clock pulse in response to the V start pulse, thereby sequentially providing a row selecting pulse to the display area 31 by each row.

Figure 4:
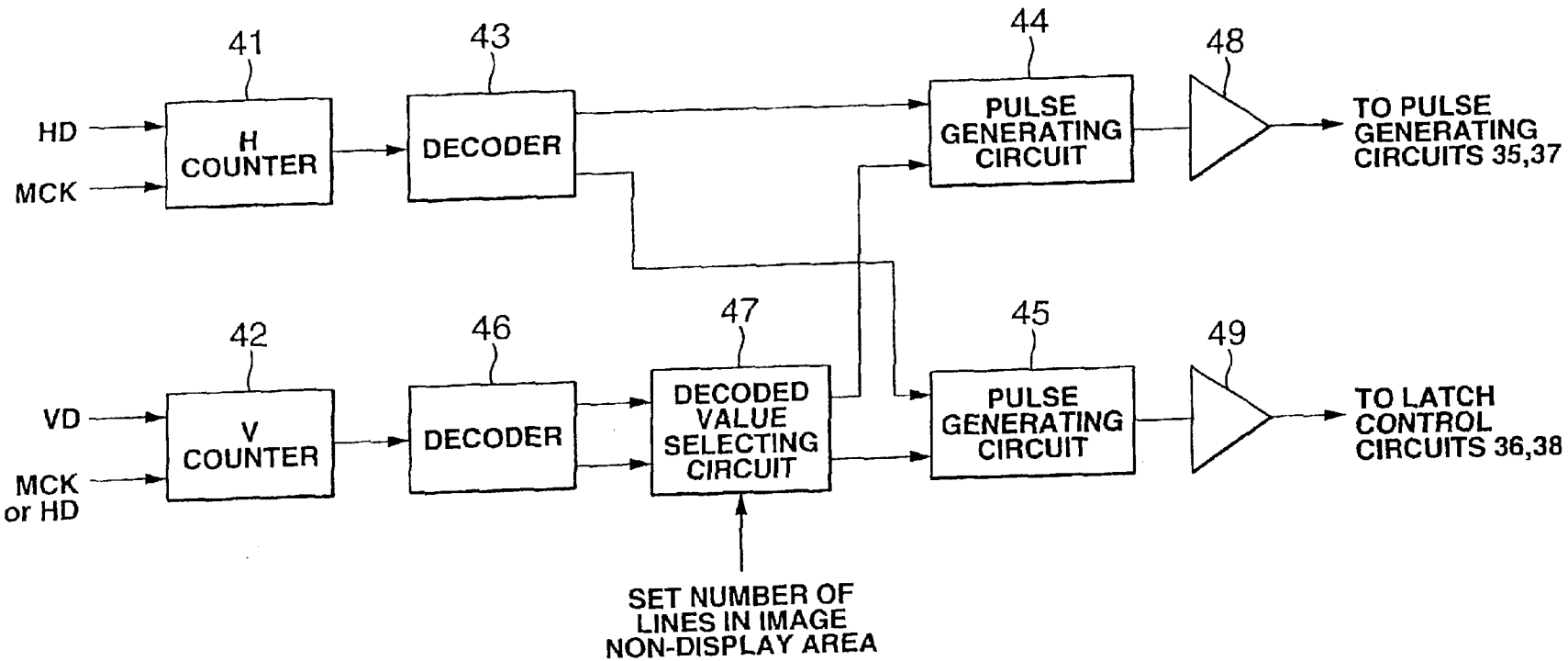
FIG. 4 is a block diagram showing an exemplary power control circuit.

FIG. 4 is a block diagram showing an exemplary structure of the power control circuit 39. In FIG. 4, a horizontal synchronizing signal HD and a master clock MCK are inputted to an H counter 41. The H counter 41 counts the master clock MCK synchronously with the horizontal synchronizing signal HD.

A vertical synchronizing signal VD and a master clock MCK are inputted to a V counter 42. The V counter 42 counts the master clock MCK synchronously with the vertical synchronizing signal VD. The V counter 42 may count the horizontal synchronizing signal HD instead of the master clock MCK.

The count value of the H counter 41 is decoded by a decoder 43 and then supplied to, for example, two pulse generating circuits 44, 45. The count value of the V counter 42 is decoded by a decoder 46 and then supplied to a decoded value selecting circuit 47. In the decoded value selecting circuit 47, the number of lines in the second row and the number of end lines in an image non-display area are set when the partial screen display mode is employed.

When the decoded value of the decoder 46 reaches the preset number of lines, the decoded value selecting circuit 47 supplies a signal to that effect to the pulse generating circuits 44, 45. The pulse generating circuits 44, 45 generate power control pulses on the basis of the decoded value of the decoder 43 at the timing when the signal is supplied from the decoded value selecting circuit 47.

The power control pulse generated by the pulse generating circuit 44 is supplied to the pulse generating circuits 35, 37 of FIG. 3 via a buffer 48. On the other hand, the power control pulse generated by the pulse generating circuit 45 is supplied to the latch control circuits 36, 38 of FIG. 3 via a buffer 49. These power control pulses act on the pulse generating circuits 35, 37 and the latch control circuits 36, 38 to stop the circuit operation.

As a modification of the power control circuit 39 of the above-described structure, there may be employed a circuit structure having a level shift circuit for shifting the signal level to one of the blocks.

The operation of the liquid crystal display device according to the second embodiment having the above-described structure will now be described. It is assumed that this liquid crystal display device has two display modes, that is, a full-screen display mode and a partial screen display mode, similarly to the liquid crystal display device of the first embodiment. These display modes are realized by the control of the second latch circuits 323, 333 by the latch control circuits 36, 38. The second latch circuits 323, 333 may also be controlled by a single latch control circuit.

In the full-screen display mode, first, the sampling and first latch circuits 322, 332 sequentially sample serially inputted display data (image data) in accordance with sampling pulses from the H shift registers 321, 331 and latch the image data of one line.

Then, the operation to collectively store the latched data of one line into the second latch circuits 323, 333 synchronously with latch control pulses from the latch control circuits 36, 38 and to read out the stored data of one line from the second latch circuits 323, 333 is sequentially repeated by each line.

The image data of one line read out from the latch circuits 323, 333 is converted to an analog signal by the DA converters 324, 334 and is outputted as display data to the respective column lines of the display area 31. Then, a row is selected in accordance with a row selecting pulse outputted from the vertical shift register 341 and the display data is sequentially written to pixel electrodes by each row. Thus, full-screen display corresponding to the serially inputted image data is made.

On the other hand, in the partial screen display mode, the screen is divided into an image display area for making prescribed image display and an image non-display area for making specified color display (in this embodiment, white or black display). In this embodiment, prescribed image display is made in an image display area made up of a plurality of lines (rows) from the top of the screen and white display is made in an image non-display area.

First, in the image display area, the operation similar to that of the full-screen display mode is carried out. Specifically, the operation to sequentially sample and latch serially inputted image data for one line by the sampling and first latch circuits 322, 332 and then collectively store and read out the latched data of one line to and from the second latch circuits 323, 333 is sequentially repeated by each line. Thus, in the image display area, normal image display corresponding to the serially inputted image data is made.

In the image non-display area, first at the beginning of the display period, serially inputted white data is sequentially sampled and latched for one line by the sampling and first latch circuits 322, 332 and the latched data of one line is collectively stored into the second latch circuits 323, 333. The stored data is passed through the DA converters 324, 334 and is outputted to the respective column lines of the display area 31. In this case, the next row (first row in the image non-display area) is selected in accordance with a row selecting pulse from the vertical shift register 341 and the data is sequentially written to pixel electrodes by each row. Thus, white display is made in the first row in the image non-display area.

The white data of one line stored in the second latch circuits 323, 333 is held in the second latch circuits 323, 333 until the image non-display period ends. With respect to the second and subsequent rows in the image non-display area, the latch control circuits 36, 38 repeatedly read out the white data of one line held in the second latch circuits 323, 333 in the cycle of one line, until the image non-display period ends.

The white data of one line thus read out is passed through the DA converters 324, 334 and is sequentially outputted to the respective column lines of the display area 31. By repeating this operation, white display is made in all the rows in the image non-display area. Ultimately, in the display area 31, normal image display is made only in a partial area and white display is made in the whole remaining area, irrespective of the inputted data.

After the display period for the first line during the image non-display period, the power control circuit 39 controls the pulse generating circuits 35, 37 to stop generating pulses, thereby stopping the entire operation of the H shift registers 321, 331 and the sampling and first latch circuits 322, 332. Moreover, the power control circuit 39 controls the latch control circuits 36, 38 to stop generating pulses for writing to the second latch circuits 323, 333, thereby stopping the write operation of the second latch circuits 323, 333.

As described above, in the liquid crystal display device having the partial screen display mode, color data of one line is first stored in the second latch circuits 323, 333 at the beginning of the image non-display period, and then the color data is repeatedly read out in the cycle of one line and outputted to the respective column lines of the display area 31 until this display period ends. Thus, since the operation to write data to the second latch circuit 323, 333 is not carried out at all substantially during the entire image non-display period, reduction in power consumption is realized by the amount of power necessary for the write operation, similarly to the first embodiment.

Moreover, since the operation of the H shift registers 321, 331 and the sampling and first latch circuits 322, 332 is not carried out during the same period, further reduction in power consumption is realized accordingly.

Figure 5:
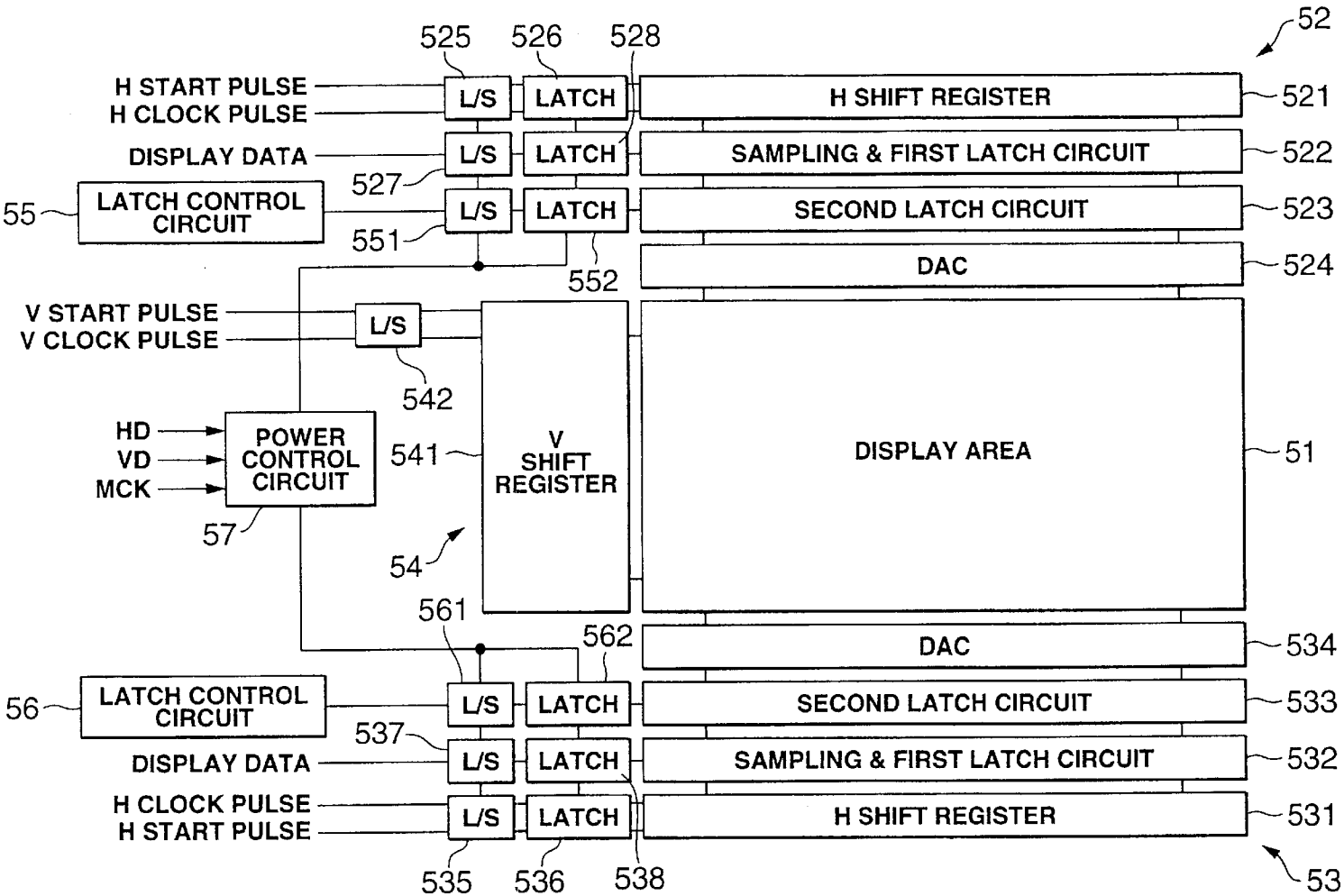
FIG. 5 is a block diagram showing an exemplary structure of a liquid crystal display device according to the third embodiment of the present invention.

FIG. 5 is a block diagram showing an exemplary structure of a liquid crystal display device according to the third embodiment of the present invention.

In FIG. 5, for example, first and second horizontal driving systems 52, 53 are arranged above and below a display area 51 of an active matrix in which pixels are arranged in the form of a matrix, and a vertical driving system 54 is arranged on the left side in FIG. 5. The horizontal driving system need not necessarily be arranged above and below the display area 51, and may also be arranged only above or below the display area 51. The vertical driving system may also be arranged on the right side in FIG. 5 or may be arranged on both the left and right sides.

At least a part of the circuit of the first and second horizontal driving systems 52, 53 and the vertical driving system 54 is integrally formed on, for example, a glass substrate which is the same substrate as that of the display area 51, by using a TFT. A second substrate (counter-substrate) is arranged to face the glass substrate at a predetermined spacing. A liquid crystal layer is held between the two substrates. In this manner, an LCD panel is constructed.

The first horizontal driving system 52 has a horizontal shift register 521, a sampling and first latch circuit 522, a second latch circuit 523 and a DA converter 524. Similarly to the first horizontal driving system 52, the second horizontal driving system 53 has a horizontal shift register 531, a sampling and first latch circuit 532, a second latch circuit 533 and a DA converter 534.

The vertical driving system 54 is constituted by a vertical shift register 541. The operation of the first and second horizontal driving systems 52, 53 and the operation of the vertical driving system 54 are the same as those in the second embodiment and therefore will not be described further in detail.

In the liquid crystal display device according to the present embodiment, an H start pulse, an H clock pulse and display data inputted to the first and second horizontal driving systems 52, 53, and a V start pulse and a V clock pulse inputted to the vertical driving system 54 are provided from peripheral circuits outside the LCD panel. These peripheral circuits are constituted as low-voltage amplitude circuits for the purpose of lowering the voltage.

Therefore, in order to provide an interface with an external low-voltage amplitude circuit, the liquid crystal display device according to the present embodiment has a level shift (L/S) circuit for level-shifting a pulse of low-voltage amplitude to a pulse of high-voltage amplitude, and a latch circuit for latching an output value of the level shift circuit.

Specifically, in the first and second horizontal driving systems 52, 53, level shift circuits 525, 535 and latch circuits 526, 536 for the H start pulse and the H clock pulse are provided, and level shift circuits 527, 537 and latch circuits 528, 538 for the display data are provided. In the vertical driving system 54, only a level shift circuit 542 for the V start pulse and the V clock pulse is provided.

For latch control circuits 55, 56 for controlling writing and reading of data to and from the second latch circuits 523, 533 of the first and second horizontal driving systems 52, 53, level shift circuits 551, 561 for level-shifting latch control pulses of the latch control circuits 55, 56 and latch circuits 552, 562 for latching the output values of the level shift circuits 551, 561 are provided.

Moreover, for the respective level shift circuits (except for the vertical driving system), the latch circuits and the latch control circuits 55, 56, there is provided a power control circuit 57 for controlling the operating states of these circuits. This power control circuit 57 controls the operating states of the level shift circuits, the latch circuits and the latch control circuits in accordance with the display mode of the display area 51. As the power control circuit 57, a circuit of basically the same structure as in FIG. 4 is used.

The operation of the liquid crystal display device according to the third embodiment will now be described. It is assumed that this liquid crystal display device has two display modes, that is, a full-screen display mode and a partial screen display mode, similarly to the liquid crystal display devices of the first and second embodiments. These display modes are realized by the control of the second latch circuits 523, 533 by the latch control circuits 55, 56. The second latch circuits 523, 533 may also be controlled by a single latch control circuit.

In the full-screen display mode, first, the sampling and first latch circuits 522, 532 sequentially sample display data, which is level-shifted by the level shift circuits 527, 537 and serially inputted via the latch circuits 528, 538, in accordance with sampling pulses from the H shift registers 521, 531 operating on the basis of an H start pulse and an H clock pulse, which are level-shifted by the level shift circuits 525, 535 and inputted via the latch circuits 526, 536. The sampling and first latch circuits 522, 532 then latch the display data of one line.

Then, the operation to collectively store the latched data of one line into the second latch circuits 523, 533 synchronously with latch control pulses, which are inputted from the latch control circuits 55, 56 via the level shift circuits 551, 561 and the latch circuits 552, 562, and to read out the stored data of one line from the second latch circuits 523, 533 is sequentially repeated by each line.

The image data of one line read out from the latch circuits 523, 533 is converted to an analog signal by the DA converters 524, 534 and is outputted as display data to the respective column lines of the display area 51. Then, a row is selected in accordance with a row selecting pulse outputted from the vertical shift register 541 on the basis of a V start pulse and a V clock pulse which are level-shifted and inputted by the level shift circuit 542, and the display data is sequentially written to pixel electrodes by each row. Thus, full-screen display corresponding to the serially inputted image data is made.

On the other hand, in the partial screen display mode, the screen is divided into an image display area for making prescribed image display and an image non-display area for making specified color display (in this embodiment, white or black display). In this embodiment, prescribed image display is made in an image display area made up of a plurality of lines (rows) from the top of the screen and white display is made in an image non-display area.

First, in the image display area, the operation similar to that of the full-screen display mode is carried out. Specifically, the operation to sequentially sample and latch serially inputted image data for one line by the sampling and first latch circuits 522, 532 and then collectively store and read out the latched data of one line to and from the second latch circuits 523, 533 is sequentially repeated by each line. Thus, in the image display area, normal image display corresponding to the serially inputted image data is made.

In the image non-display area, first at the beginning of the display period, serially inputted white data is sequentially sampled and latched for one line by the sampling and first latch circuits 522, 532 and the latched data of one line is collectively stored into the second latch circuits 523, 533. The stored data is passed through the DA converters 524, 534 and is outputted to the respective column lines of the display area 51. In this case, the next row (first row in the image non-display area) is selected in accordance with a row selecting pulse from the vertical shift register 541 and the data is sequentially written to pixel electrodes by each row. Thus, white display is made in the first row in the image non-display area.

The white data of one line stored in the second latch circuits 523, 533 is held in the second latch circuits 523, 533 until the image non-display period ends. With respect to the second and subsequent rows in the image non-display area, the latch control circuits 55, 56 repeatedly read out the white data of one line held in the second latch circuits 523, 533 in the cycle of one line, until the image non-display period ends.

The white data of one line thus read out is passed through the DA converters 524, 534 and is sequentially outputted to the respective column lines of the display area 51. By repeating this operation, white display is made in all the rows in the image non-display area. Ultimately, in the display area 51, normal image display is made only in a partial area and white display is made in the whole remaining area, irrespective of the inputted data.

After the display period for the first line during the image non-display period, all of the operation of the level shift circuits 525, 535, 527, 537, the operation of the H shift registers 521, 531 and the sampling and first latch circuits 522, 532, and the write operation of the second latch circuits 523, 533 are stopped. This control is carried out by the latch control circuits 55, 56 and the power control circuit 57, or only by the power control circuit 57.

Specifically, the power control circuit 57 controls all of the level shift circuits 525, 535, the level shift circuits 527, 537, and the level shift circuits 551, 561 to enter inactive states. The timing for setting the inactive states is when the H start pulse and the latch control pulse are inactive and the display data is white data.

By doing so, the data is latched by the latch circuits 526, 536, 528, 538 provided on the subsequent stages to the level shift circuits 525, 535, 527, 537, so as to stop the operation of the H shift registers 521, 531 and the operation of the sampling and first latch circuits 522, 532. Therefore, all of the operation of the H shift registers 521, 531 and the operation of the sampling and first latch circuits 522, 532 are stopped.

Similarly, the data is latched by the latch circuits 552, 562 provided on the subsequent stages to the level shift circuits 551, 561, so as to stop the write operation of the second latch circuits 523, 533. Therefore, the operation of the second latch circuits 523, 533 is stopped, too.

As described above, in the liquid crystal display device having the partial screen display mode, color data of one line is first stored in the second latch circuits 523, 533 at the beginning of the image non-display period, and then the color data is repeatedly read out in the cycle of 1H and outputted to the respective column lines of the display area 51 until this display period ends. Thus, since the operation to write data to the second latch circuit 523, 533 is not carried out at all substantially during the entire image non-display period, reduction in power consumption is realized by the amount of power necessary for the write operation, similarly to the first and second embodiments.

Moreover, since the operation of level shift circuits 525, 535, 527, 537, the operation of the level shift circuits 551, 561, the operation of the H shift registers 521, 531, and the operation of the sampling and first latch circuits 522, 532 are not carried out during the same period, further reduction in power consumption is realized accordingly.

Figure 6:
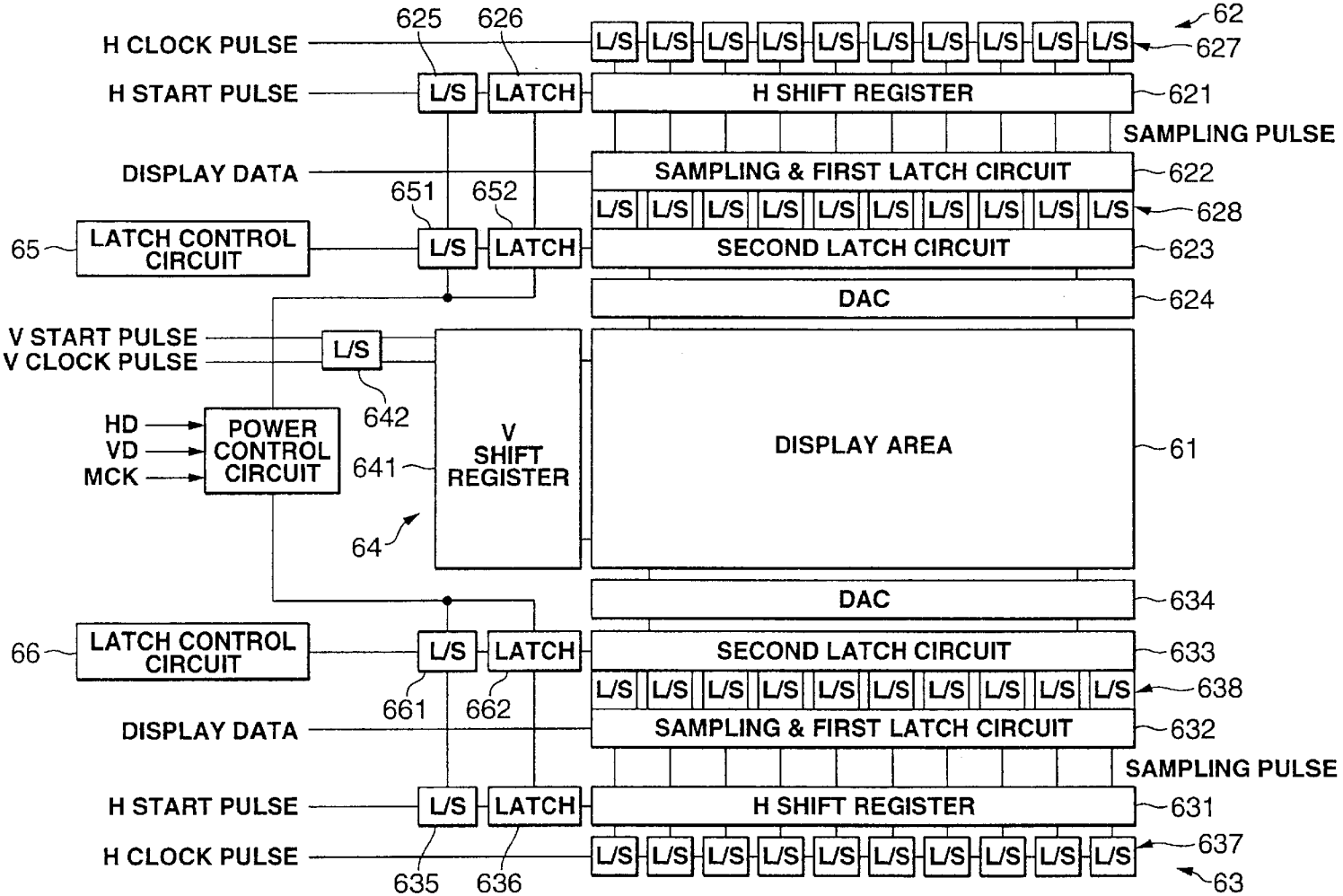
FIG. 6 is a block diagram showing an exemplary structure of a liquid crystal display device according to the fourth embodiment of the present invention.

FIG. 6 is a block diagram showing an exemplary structure of a liquid crystal display device according to the fourth embodiment of the present invention.

In FIG. 6, for example, first and second horizontal driving systems 62, 63 are arranged above and below a display area 61 of an active matrix in which pixels are arranged in the form of a matrix, and a vertical driving system 64 is arranged on the left side in FIG. 6. The horizontal driving system need not necessarily be arranged above and below the display area 61, and may also be arranged only above or below the display area 61. The vertical driving system may also be arranged on the right side in FIG. 6 or may be arranged on both the left and right sides.

At least a part of the circuit of the first and second horizontal driving systems 62, 63 and the vertical driving system 64 is integrally formed on, for example, a glass substrate which is the same substrate as that of the display area 61, by using a TFT. A second substrate (counter-substrate) is arranged to face the glass substrate at a predetermined spacing. A liquid crystal layer is held between the two substrates. In this manner, an LCD panel is constructed.

The first horizontal driving system 62 has a horizontal shift register 621, a sampling and first latch circuit 622, a second latch circuit 623 and a DA converter 624. Similarly to the first horizontal driving system 62, the second horizontal driving system 63 has a horizontal shift register 631, a sampling and first latch circuit 632, a second latch circuit 633 and a DA converter 634.

The vertical driving system 64 is constituted by a vertical shift register 641. The operation of the first and second horizontal driving systems 62, 63 and the operation of the vertical driving system 64 are the same as those in the second embodiment and therefore will not be described further in detail.

In the liquid crystal display device according to the present embodiment, an H start pulse, an H clock pulse and display data inputted to the first and second horizontal driving systems 62, 63, and a V start pulse and a V clock pulse inputted to the vertical driving system 64 are provided from peripheral circuits outside the LCD panel, similarly to the third embodiment. These peripheral circuits are constituted as low-voltage amplitude circuits for the purpose of lowering the voltage.

Therefore, in order to provide an interface with an external low-voltage amplitude circuit, the liquid crystal display device according to the present embodiment, too, has a level shift (L/S) circuit for level-shifting a pulse of low-voltage amplitude to a pulse of high-voltage amplitude, and a latch circuit for latching an output value of the level shift circuit.

Specifically, in the first and second horizontal driving systems 62, 63, level shift circuits 625, 635 and latch circuits 626, 636 for the H start pulse are provided and level shift circuit groups 627, 637 for the H clock pulse are provided corresponding to the respective shift stages. Moreover, level shift circuit groups 628, 638 for the display data are provided corresponding to the respective latch stages of the sampling and first latch circuits 622, 632. In the vertical driving system 64, only a level shift circuit 642 for the V start pulse and the V clock pulse is provided.

For latch control circuits 65, 66 for controlling writing and reading of data to and from the second latch circuits 623, 633 of the first and second horizontal driving systems 62, 63, level shift circuits 651, 661 for level-shifting latch control pulses of the latch control circuits 65, 66 and latch circuits 652, 662 for latching the output values of the level shift circuits 651, 661 are provided.

Moreover, for the respective level shift circuits (except for the vertical driving system), the latch circuits and the latch control circuits 65, 66, there is provided a power control circuit 67 for controlling the operating states of these circuits. This power control circuit 67 controls the operating states of the level shift circuits, the latch circuits and the latch control circuits in accordance with the display mode of the display area 61. As the power control circuit 67, a circuit of basically the same structure as in FIG. 4 is used.

The operation of the liquid crystal display device according to the fourth embodiment will now be described. It is assumed that this liquid crystal display device has two display modes, that is, a full-screen display mode and a partial screen display mode, similarly to the liquid crystal display devices of the first, second and third embodiments. These display modes are realized by the control of the second latch circuits 623, 633 by the latch control circuits 65, 66. The second latch circuits 623, 633 may also be controlled by a single latch control circuit.

In the full-screen display mode, first, an H start pulse is level-shifted by the level shift circuits 625, 635 and then inputted to the H shift registers 621, 631 via the latch circuits 626, 636. Thus, the first stages of the level shift circuit groups 627, 637 become active and the operation of the H shift registers 621, 631 starts.

In the level shift circuit groups 627, 637, the circuit stages on completion of transfer sequentially become inactive. The specific circuit structure thereof will be described later.

Subsequently, the sampling and first latch circuits 622, 632 sequentially sample serially inputted display data in accordance with sampling pulses from the H shift registers 621, 631, then level-shift the display data through the level shift circuit groups 628, 638, and latch the display data of one line to latch units.

Then, the operation to collectively store the latched data of one line into the second latch circuits 623, 633 synchronously with latch control pulses, which are inputted from the latch control circuits 65, 66 via the level shift circuits 651, 661 and the latch circuits 652, 662, and to read out the stored data of one line from the second latch circuits 623, 633 is sequentially repeated by each line.

The image data of one line read out from the latch circuits 623, 633 is converted to an analog signal by the DA converters 624, 634 and is outputted as display data to the respective column lines of the display area 61. Then, a row is selected in accordance with a row selecting pulse outputted from the vertical shift register 641 on the basis of a V start pulse and a V clock pulse which are level-shifted and inputted by the level shift circuit 642, and the display data is sequentially written to pixel electrodes by each row. Thus, full-screen display corresponding to the serially inputted image data is made.

On the other hand, in the partial screen display mode, the screen is divided into an image display area for making prescribed image display and an image non-display area for making specified color display (in this embodiment, white or black display). In this embodiment, prescribed image display is made in an image display area made up of a plurality of lines (rows) from the top of the screen and white display is made in an image non-display area.

First, in the image display area, the operation similar to that of the full-screen display mode is carried out. Specifically, the operation to sequentially sample and latch serially inputted image data for one line by the sampling and first latch circuits 622, 632 and then collectively store and read out the latched data of one line to and from the second latch circuits 623, 633 is sequentially repeated by each line. Thus, in the image display area, normal image display corresponding to the serially inputted image data is made.

In the image non-display area, first at the beginning of the display period, serially inputted white data is sequentially sampled and latched for one line by the sampling and first latch circuits 622, 632 and the latched data of one line is collectively stored into the second latch circuits 623, 633. The stored data is passed through the DA converters 624, 634 and is outputted to the respective column lines of the display area 61. In this case, the next row (first row in the image non-display area) is selected in accordance with a row selecting pulse from the vertical shift register 641 and the data is sequentially written to pixel electrodes by each row. Thus, white display is made in the first row in the image non-display area.

The white data of one line stored in the second latch circuits 623, 633 is held in the second latch circuits 623, 633 until the image non-display period ends. With respect to the second and subsequent rows in the image non-display area, the latch control circuits 65, 66 repeatedly read out the white data of one line held in the second latch circuits 623, 633 in the cycle of one line, until the image non-display period ends.

The white data of one line thus read out is passed through the DA converters 624, 634 and is sequentially outputted to the respective column lines of the display area 61. By repeating this operation, white display is made in all the rows in the image non-display area. Ultimately, in the display area 61, normal image display is made only in a partial area and white display is made in the whole remaining area, irrespective of the inputted data.

After the display period for the first line during the image non-display period, all of the operation of the level shift circuits 625, 635, the operation of the H shift registers 621, 631, the operation of the level shift circuit groups 627, 637, the operation of the sampling and first latch circuits 622, 632, the operation of the level shift circuit groups 628, 638, and the write operation of the second latch circuits 623, 633 are stopped.

This control is carried out by the latch control circuits 65, 66 and the power control circuit 67, or only by the power control circuit 67. Specifically, the power control circuit 67 controls all of the level shift circuits 625, 635 and the level shift circuits 651, 661 to enter inactive states. The timing for setting the inactive states is when the H start pulse and the latch control pulse are inactive and the display data is white data.

By doing so, the data is latched by the latch circuits 626, 636 provided on the subsequent stages to the level shift circuits 625, 635, so as to stop the operation of the H shift registers 621, 631. Therefore, all of the operation of the H shift registers 621, 631, the operation of the sampling and first latch circuits 622, 632 and the operation of the level shift circuit groups 628, 638 are stopped.

Similarly, the data is latched by the latch circuits 652, 662 provided on the subsequent stages to the level shift circuits 651, 661, so as to stop the write operation of the second latch circuits 623, 633. Therefore, the operation of the second latch circuits 623, 633 is stopped, too.

As described above, in the liquid crystal display device having the partial screen display mode, color data of one line is first stored in the second latch circuits 623, 633 at the beginning of the image non-display period, and then the color data is repeatedly read out in the cycle of 1H and outputted to the respective column lines of the display area 61 until this display period ends. Thus, since the operation to write data to the second latch circuit 623, 633 is not carried out at all substantially during the entire image non-display period, reduction in power consumption is realized by the amount of power necessary for the write operation, similarly to the first, second and third embodiments.

Moreover, since the operation of level shift circuits 625, 635, the operation of the level shift circuits 651, 661, the operation of the H shift registers 621, 631, the operation of the level shift circuit groups 627, 637, the operation of the sampling and first latch circuits 622, 632, and the operation of the level shift circuit groups 628, 638 are not carried out during the same period, further reduction in power consumption is realized accordingly.

Figure 7:
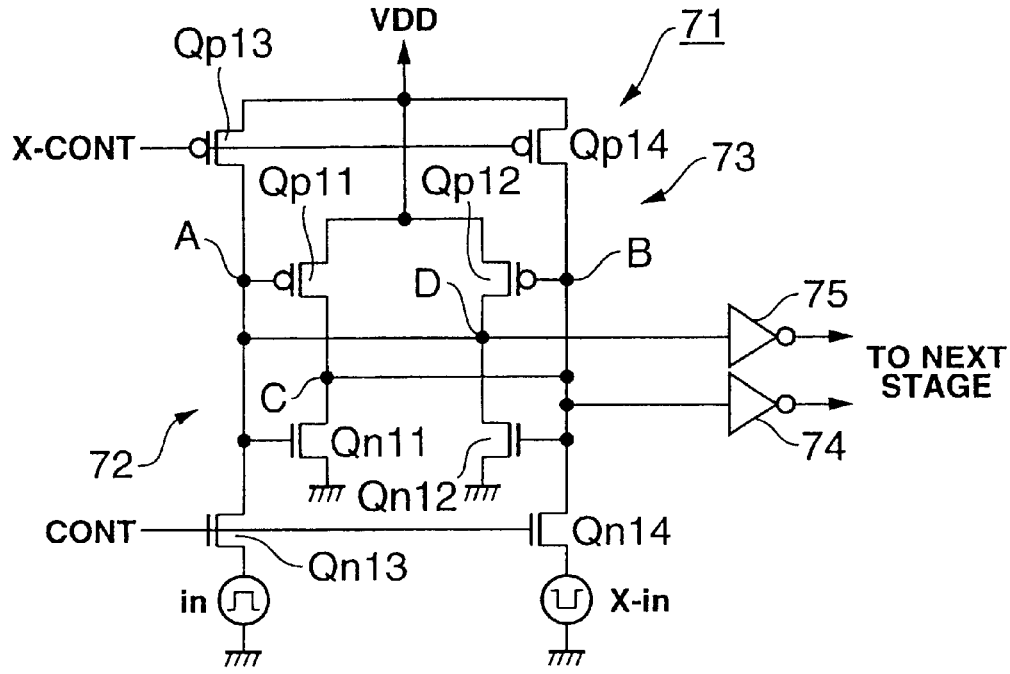
FIG. 7 is a circuit diagram showing an exemplary structure of a level shift and latch circuit used in the liquid crystal display devices according to the third and fourth embodiments.

FIG. 7 is a circuit diagram showing an exemplary structure of the level shift circuit and the latch circuit (hereinafter referred to as level shift and latch circuit) used in the liquid crystal display device according to the third and fourth embodiments. The level shift and latch circuit of this example has a CMOS latch cell 71 as its basic structure.

The CMOS latch cell 71 is constituted by a CMOS inverter 72 made up of an NMOS transistor Qn11 and a PMOS transistor Qp11 having their respective gates and drains connected at common points, and a CMOS inverter 73 made up of an NMOS transistor Qn12 and a PMOS transistor Qp12 having their respective gates and drains connected at common points, with the CMOS inverter 72 and the CMOS inverter 73 being connected in parallel with each other between a power source VDD and the ground.

In this CMOS latch cell 71, an input terminal A of the CMOS inverter 72, that is, a common connection point A of the gates of the MOS transistors Qn11 and Qp11, is connected with an output terminal D of the CMOS inverter 73, that is, a common connection point D of the drains of the MOS transistors Qn12 and Qp12. An input terminal B of the CMOS inverter 73, that is, a common connection point B of the gates of the MOS transistors Qn12 and Qp12, is connected with an output terminal C of the CMOS inverter 72, that is, a common connection terminal C of the drains of the MOS transistors Qn11 and Qp11.

Moreover, PMOS transistors Qp13, Qp14 are connected between the input terminals A, B of the CMOS inverters 72, 73 and the power source VDD, respectively. Input signals in, X-in are inputted to the input terminals A, B of the CMOS inverters 72, 73 via the NMOS transistors Qn13, Qn14. Data led out from the output terminals C, D of the CMOS inverters 72, 73 are supplied to the next stage via inverters 74, 75.

In the level shift and latch circuit of the above-described structure, a control pulse CONT is supplied to the gates of the NMOS transistors Qn13, Qn14 and its inversion pulse X-CONT is supplied to the gates of the PMOS transistors Qp13, Qp14 from the power control circuit 57 of FIG. 5 or the power control circuit 67 of FIG. 6, thus controlling the operating state.

As is clear from the above description, since the level shift and latch circuit of this example has the two circuits by using the same circuit element, it is very effective for reduction in the area of the circuit and hence realization of space-saving of the device.

Figure 8:
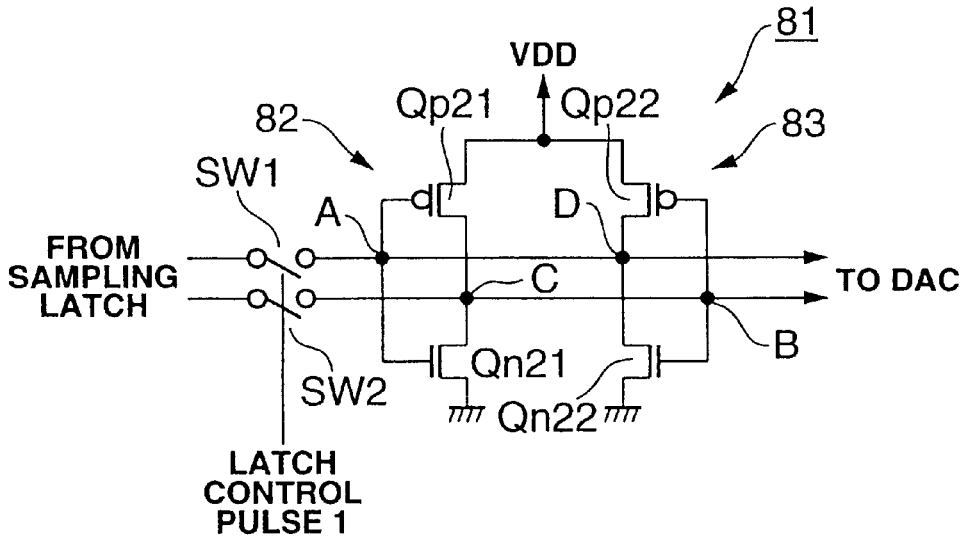
FIG. 8 is a circuit diagram showing an exemplary structure of a second latch circuit used in the liquid crystal display device according to the present invention.

FIG. 8 is a circuit diagram showing an exemplary structure of the second latch circuit used in the liquid crystal display device according to the above-described embodiments. In the example of FIG. 8, the structure of a unit circuit corresponding to each column in the display area is shown. The second latch circuit of this example, too, has a CMOS latch cell as its basic structure.

A CMOS latch cell 81 is constituted by a CMOS inverter 82 made up of an NMOS transistor Qn21 and a PMOS transistor Qp21 having their respective gates and drains connected at common points, and a CMOS inverter 83 made up of an NMOS transistor Qn22 and a PMOS transistor Qp22 having their respective gates and drains connected at common points, with the CMOS inverter 82 and the CMOS inverter 83 being connected in parallel with each other between a power source VDD and the ground.

In this CMOS latch cell 81, an input terminal A of the CMOS inverter 82, that is, a common connection point A of the gates of the MOS transistors Qn21 and Qp21, is connected with an output terminal D of the CMOS inverter 83, that is, a common connection point D of the drains of the MOS transistors Qn22 and Qp22. An input terminal B of the CMOS inverter 83, that is, a common connection point B of the gates of the MOS transistors Qn22 and Qp22, is connected with an output terminal C of the CMOS inverter 82, that is, a common connection terminal C of the drains of the MOS transistors Qn21 and Qp21.

Data is inputted to the input terminals A, B of the CMOS inverters 82, 83 from the sampling and first latch circuit via switches SW1, SW2, whereas latched data is led out from the output terminals C, D of the CMOS inverters 82, 83 and supplied to the DA converter. The switches SW1, SW2 are ON/OFF-controlled by a latch control pulse supplied from the latch control circuit.

Figure 9:
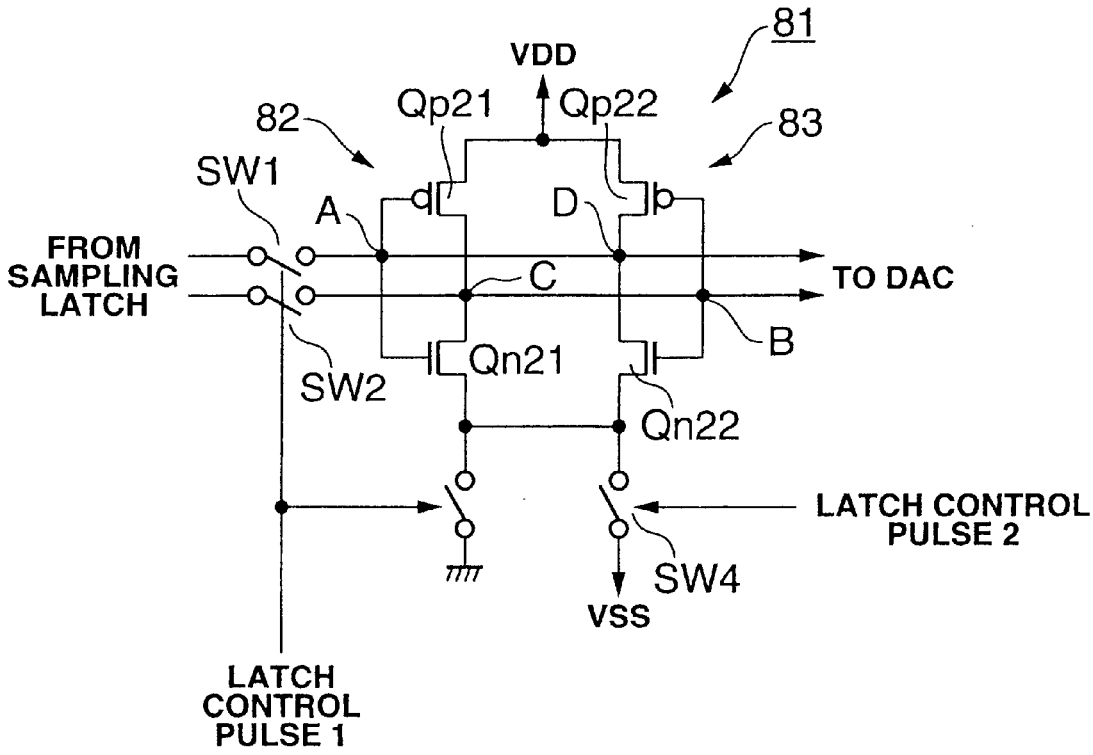
FIG. 9 is a circuit diagram showing another exemplary structure of the second latch circuit used in the liquid crystal display device according to the present invention.

FIG. 9 is a circuit diagram showing another exemplary structure of the second latch circuit. In FIG. 9, parts equivalent to those in FIG. 8 are denoted by the same symbols and numerals. The second latch circuit of this example has a circuit structure which also handles a level shift in the direction of negative voltage.

Specifically, the sources of the NMOS transistors Qn21, Qn22 of the CMOS inverters 82, 83 are connected at a common point. This common connection point is connected to the ground via a switch SW3 and is further connected to a negative power source VSS via a switch SW4. The switch SW3 is ON/OFF-controlled together with the switches SW1, SW2 by a latch control pulse 1 supplied from the latch control circuit, and the switch SW4 is ON/OFF-controlled by a latch control pulse 2.

Figure 10:
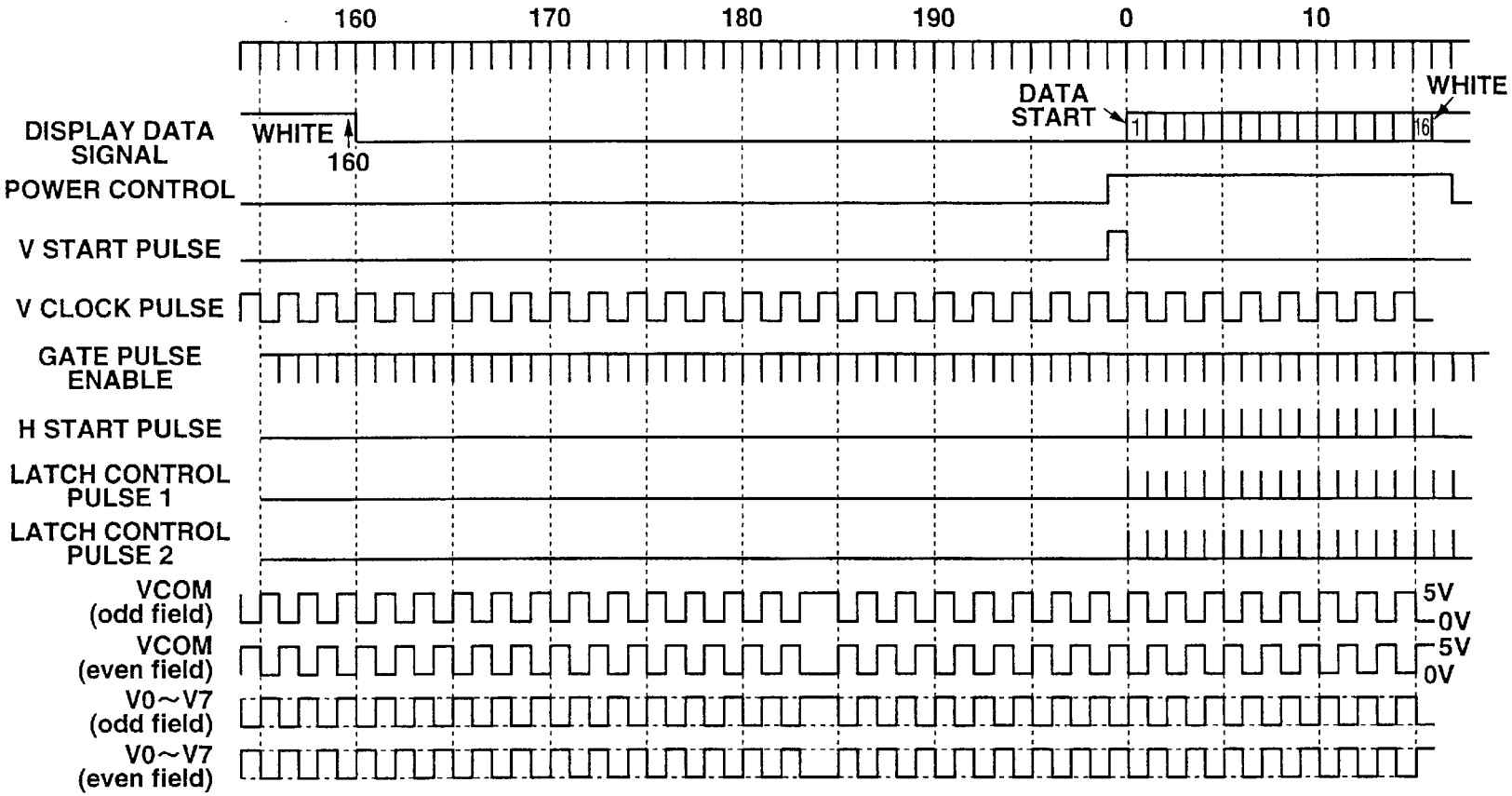
FIG. 10 is a timing chart showing an exemplary operation of the liquid crystal display device according to the present invention.

FIG. 10 is a timing chart showing an exemplary operation of the liquid crystal display device according to the above-described embodiments. In this example, the number of vertical effective pixels (number of lines) is 160, the image display area consists of the first to 16th rows, and the image non-display (white display) area consists of 17th to 160th rows.

In this example, the image non-display (white display) area is controlled so that the operations of the level shift circuits for H start pulse, H clock pulse, display data image and latch control pulse, the H shift register, and the sampling and first latch circuit are stopped, and so that the write operation of the second latch circuit is not carried out.

Figure 11:
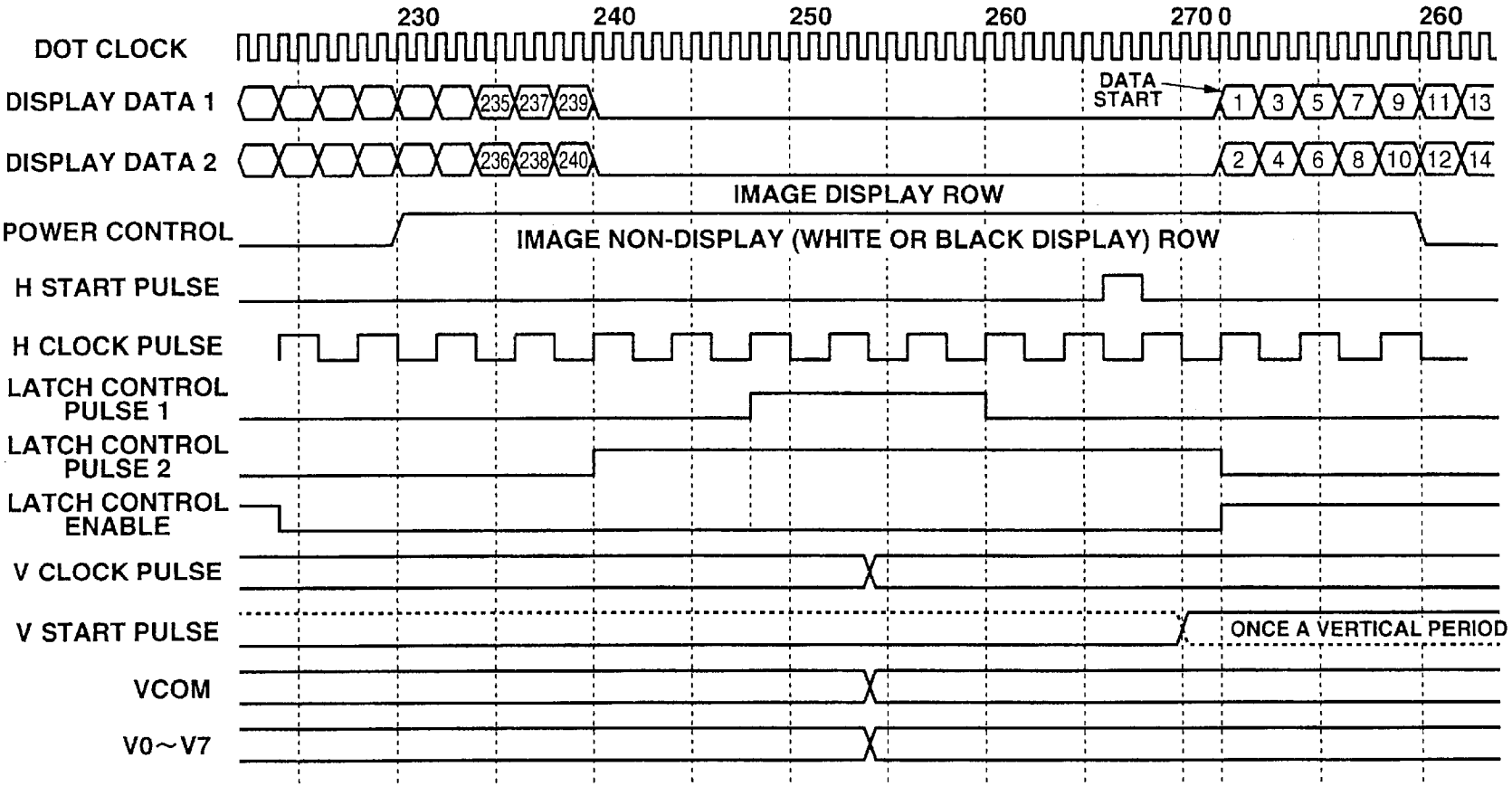
FIG. 11 is a timing chart showing the details of an exemplary operation near the horizontal interval time code.

FIG. 11 is a timing chart showing the details of an exemplary operation near the horizontal interval time code in the timing chart of FIG. 10. In this example, the number of horizontal effective pixels is 240.

In the above-described embodiments, the circuit operation prior to the write operation of the second latch circuit is stopped only during the image non-display period (white display period) as the operation of the power control circuit in the liquid crystal display device according to the above-described embodiments. However, as shown in the timing chart of FIG. 11, it is possible to constitute the circuit so as to stop the operation also during the period when the H start pulse and the latch control pulse are inactive.

By thus controlling the power control circuit to stop the circuit operation prior to the write operation of the second latch circuit during the period when the H start pulse and the latch control pulse are inactive, reduction in power consumption is made possible not only in the partial screen display mode but also in the full-screen display mode.

Figure 12:
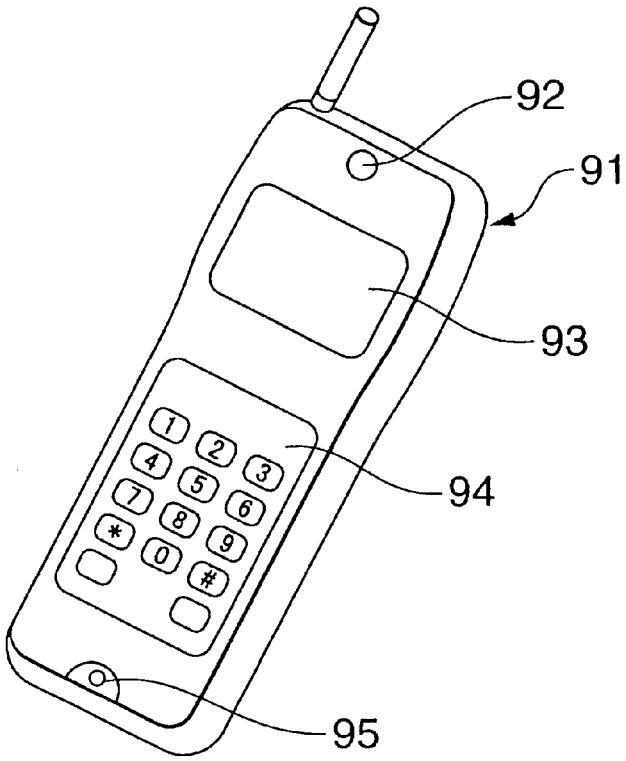
FIG. 12 schematically shows the appearance of a portable telephone to which the present invention is applied.

FIG. 12 schematically shows the appearance of a portable terminal equipment, for example, a portable telephone, to which the present invention is applied.

The portable telephone of this example has a structure such that a speaker part 92, a display part 93, an operating part 94 and a microphone part 95 are sequentially arranged from the top on the front side of a device casing 91. In the portable telephone of such a structure, for example, a liquid crystal display device is used for the display part 93. As this liquid crystal display device, any of the liquid crystal display devices according to the above-described embodiments is used.

Figure 13:
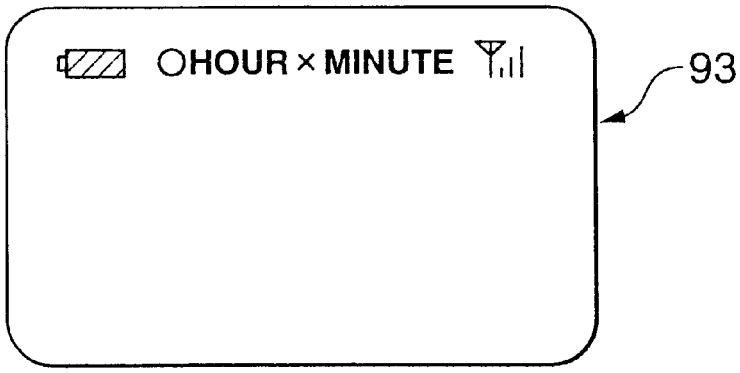
FIG. 13 shows an exemplary screen display in a partial screen display mode.

The display part 93 in the portable telephone of this type has a partial screen display mode for making display only in a part of the screen, as the display function of the standby mode or the like. For example, in the standby mode, information such as the remaining capacity of the battery and the sensitivity or time is constantly displayed in the uppermost part of the screen, as shown in FIG. 13. Then, for example, white display is made in the remaining area.

By thus using the liquid crystal display device according to any of the above-described embodiments or an EL display device as the display part 93 in the portable telephone having mounted thereon the display part 93 with the partial screen display function, the continuous availability time based on the battery power can be increased since the display device enables reduction in power consumption.

In this example, the present invention is applied to the potable telephone. However, the present invention is not limited this example and can be broadly applied to portable terminal equipments such as a secondary unit of a telephone set or a PDA (personal digital assistant).

Industrial Applicability

As described above, with the display device having a partial screen display mode according to the present invention and the terminal device having the display device mounted thereon, in the partial screen display mode, color data of one line is first stored into the storage means at the beginning of the display period, and then the stored data is repeatedly read out and supplied as display data of each pixel to the display area. Thus, since the operation to write data to the storage means is not carried out substantially during the entire image non-display period, reduction in power consumption is realized with a simple circuit structure.

What is claimed is:

1. A display device having pixels within a display area, the display area being divided into an image display area and an image non-display area, the image display area having contiguous rows of the pixels for displaying a prescribed image and the image non-display area having contiguous rows of the pixels for displaying only a specified color, the display device comprising:

a horizontal driving system including a latch circuit that receives display data and latch control pulses, wherein:

said latch control pulses command said latch circuit to capture said display data for each of said contiguous rows within said image display area and to capture said display data for the first of said contiguous rows within said image non-display area; and said latch control pulses cease once said display data for the first of said contiguous rows have been captured, said captured display data for said first of said contiguous rows being provided as said display data for said contiguous rows within said image non-display area.

2. The display device as claimed in 1, wherein a latch control pulse of said latch control pulses commands said latch circuit to store said display data for a row of said pixels.

3. The display device as claimed in claim 1, wherein the display element of said pixels in the display area is made up of a liquid crystal cell.

4. The display device as claimed in claim 1, wherein the display element of said pixels in the display area is made up of an electroluminescence element.

5. The display device as claimed in claim 1, wherein said specified color is white or black.

6. The display device as claimed in claim 1, further comprising:

a vertical driving system that selects one of a plurality of row lines to write image data from said plurality of column lines to a row of said pixels.

7. The display device as claimed in claim 6, wherein said horizontal driving system provides said image data to said plurality of column lines, said horizontal driving system further comprises:

a digital-to-analog converter that receives from said latch circuit said captured display data for each of said contiguous rows within said image display area and said captured display data for said first of said contiguous rows within said image non-display area, said digital-to-analog converter converting said captured display data for said each of said contiguous rows and said captured display data for said first of said contiguous rows into said image data.

8. The display device as claimed in claim 6, wherein one of said pixels is located at an intersection of one of said plurality of row lines and one of said plurality of column lines.

9. The display device as claimed in claim 6, wherein said digital-to-analog converter performs digital-to-analog conversion on said display data to convert said display data into said image data.

10. The display device as claimed in claim 6, further comprising a level shift circuit that level-shifts latch control pulses having low-voltage amplitude to latch control pulses having high-voltage amplitude, high-voltage amplitude said latch control pulses being provided to said latch circuit as said latch control pulses.

11. The display device as claimed in claim 6, further comprising a plurality of level shift circuits, said plurality of level shift circuits level-shifts display data for said each of said contiguous rows within said image display area from a low-voltage amplitude to a high-voltage amplitude and level-shifts display data for said first of said contiguous rows within said image non-display area from a low-voltage amplitude to a high-voltage amplitude, said high-voltage amplitude display data for said each of said contiguous rows being provided to said digital-to-analog converter as said captured display data for each of said contiguous rows within said image display area, and said high-voltage amplitude display data for said first of said contiguous rows within said image non-display area being provided to said digital-to-analog converter as said captured display data for said each of said contiguous rows and said captured display data for said first of said contiguous rows into said image data.

12. The display device as claimed in claim 1, wherein said horizontal driving system further comprises a sampling and first latch circuit that converts serial image data for a row of said pixels into said display data.

13. The display device as claimed in claim 12, further comprising a plurality of level shift circuits, one of said plurality of level shift circuits level-shifts serial image data having low-voltage amplitude to serial image data having high-voltage amplitude, said serial image data high-voltage amplitude being provided to said sampling and first latch circuit as said serial image data, and another of said plurality of level shift circuits level-shifts latch control pulses having low-voltage amplitude to latch control pulses having high-voltage amplitude, said high-voltage amplitude latch control pulses being provided to said latch circuit as said latch control pulses.

14. A portable terminal equipment comprising:

a speaker part; an operating part; and a microphone part; and a display part, wherein:

said display part includes pixels within a display area, a vertical driving system that selects one of a plurality of row lines to write said image data from said plurality of column lines to a row of said pixels, and a horizontal driving system including a latch circuit that receives display data and latch control pulses;

said display area is divided into an image display area and an image non-display area, the image display area having contiguous rows of the pixels for displaying a prescribed image and the image non-display area having contiguous rows of the pixels for displaying only a specified color;

said latch control pulses command said latch circuit to capture said display data for each of said contiguous rows within said image display area and to capture said display data for the first of said contiguous rows within said image non-display area; and said latch control pulses cease once said display data for the first of said contiguous rows have been captured, said captured display data for said first of said contiguous rows being provided as said display data for said contiguous rows within said image non-display area.

15. A method for driving a display device having pixels within a display area, the display area being divided into an image display area and an image non-display area, the image display area having contiguous rows of pixels for displaying a prescribed image and the image non-display area having contiguous rows of pixels for displaying only a specified color, the method comprising the steps of:

generating a plurality of latch control pulses;

using one of a plurality of latch control pulses to capture display data for a row of said pixels within said image display area;

using others of said plurality of latch control pulses to capture display data for the remaining rows of said pixels within said image display area;

using another of said plurality of latch control pulses to capture display data for the first row of said pixels within said image non-display area;

terminating the generation of said plurality of latch control pulses; and using said captured display data for said first row of said pixels as display data for the remaining rows of said pixels within said image non-display area after the generation of said plurality of latch control pulses has been terminated.

16. The method as claimed in claim 15, wherein said specified color is white or black.

17. The method as claimed in claim 15, further comprising:

performing analog-to-digital conversion on said captured display data for said row of said pixels within said image display area;

providing said converted display data to a plurality of column lines;

selecting one of a plurality of row lines for said image display area to write said converted display data from said plurality of column lines to said row of said pixels.

18. The method as claimed in claim 17, further comprising:

a) performing analog-to-digital conversion on said captured display data for the next of said remaining rows of said pixels within said image display area;

b) providing said converted display data for said next of said remaining rows of said pixels to said plurality of column lines;

c) selecting the next of said plurality of row lines for said image display area to write said converted display data for said next of said remaining rows of said pixels from said plurality of column lines to the next of said remaining rows; and d) repeating steps a), b) and c) on each of said display data for the remaining rows of said pixels within said image display area.

19. The method as claimed in claim 15, further comprising:

performing analog-to-digital conversion on said captured display data for said first row of said pixels within said image non-display area;

providing said converted display data for said first row of said pixels to a plurality of column lines; and selecting a first of a plurality of row lines for said image non-display area to write said converted display data for said first row of said pixels from said plurality of column lines to said first row within said image non-display area.

20. The method as claimed in claim 19, further comprising:

sequentially selecting remaining ones of said plurality of row lines for said image non-display area to write said converted display data for said first row of said pixels from said plurality of column lines to said remaining rows of said pixels within said image non-display area.

* * * * *